US010374334B2

(12) United States Patent
Li et al.

(10) Patent No.: US 10,374,334 B2
(45) Date of Patent: Aug. 6, 2019

(54) CABLE CONNECTOR

(71) Applicant: Tyco Electronics (Shanghai) Co. Ltd., Shanghai (CN)

(72) Inventors: Hua Li, Shanghai (CN); Shu Chen, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/878,924

(22) Filed: Jan. 24, 2018

(65) Prior Publication Data

US 2018/0212344 A1 Jul. 26, 2018

(30) Foreign Application Priority Data

Jan. 24, 2017 (CN) ..... 2017 1 0054500

(51) Int. Cl.

| | |
|---|---|
| ***H01R 9/03*** | (2006.01) |
| ***H01R 9/16*** | (2006.01) |
| ***H01R 25/14*** | (2006.01) |
| ***H01R 4/18*** | (2006.01) |
| ***H01R 11/11*** | (2006.01) |
| *H01R 13/11* | (2006.01) |

(52) U.S. Cl.

CPC ..... *H01R 9/03* (2013.01); *H01R 4/184* (2013.01); *H01R 9/16* (2013.01); *H01R 11/11* (2013.01); *H01R 25/142* (2013.01); *H01R 13/113* (2013.01)

(58) Field of Classification Search

CPC ..... H01R 9/03; H01R 13/567

USPC ..... 439/854, 855, 881

See application file for complete search history.

(56) References Cited

U.S. PATENT DOCUMENTS 2,429,585 A * 10/1947 Rogoff ..... H01R 4/20 174/84 C
2,526,277 A * 10/1950 Rogoff ..... H01R 4/20 174/87
2,674,647 A * 4/1954 Dibner ..... H01R 4/20 174/74 A
2,802,257 A * 8/1957 Holtzapple ..... H01R 4/206 174/84 C
2,945,206 A * 7/1960 Hammell ..... 439/881
2,965,147 A * 12/1960 Hoffman ..... H01R 4/20 29/282
3,694,564 A * 9/1972 Pater ..... H01R 9/2491 174/72 R
4,298,243 A * 11/1981 Swengel, Jr. ..... H01R 13/115 439/730
4,337,374 A * 6/1982 Smith ..... H02G 15/10 174/138 F (Continued)

*Primary Examiner* — Ross N Gushi

(74) *Attorney, Agent, or Firm* — Barley Snyder

(57) ABSTRACT

A cable connector comprises a housing having a first receiving portion extending in a longitudinal direction of the cable connector and a first terminal disposed in the first receiving portion. The first terminal has a first cable connection portion at a first end of the first terminal. The first cable connection portion has a hollow cylindrical shape with a center axis extending in a lateral direction of the cable connector. A plurality of first cables electrically connected to the first cable connection portion are inserted into a first end of the first cable connection portion or are inserted into both the first end and an opposite second end of the first cable connection portion.

18 Claims, 8 Drawing Sheets

(56) References Cited

U.S. PATENT DOCUMENTS 4,421,375 A * 12/1983 Coldren ..... H01R 4/2462 439/423
4,721,471 A * 1/1988 Mueller ..... H01R 25/003 439/78
4,902,243 A * 2/1990 Davis ..... H01R 12/675 439/405
5,021,611 A * 6/1991 Amano ..... H01R 4/70 156/49
5,024,610 A * 6/1991 French ..... H01R 13/113 439/857
5,371,323 A * 12/1994 Schneider ..... H01R 4/646 174/138 F
5,504,275 A * 4/1996 Scramoncin ..... H01R 4/187 174/84 C
5,962,811 A * 10/1999 Rodrigues ..... H02G 15/10 174/76
6,109,975 A * 8/2000 Nitta ..... H01R 33/06 439/596
6,666,708 B2 * 12/2003 Saito ..... H01R 12/727 439/372
6,827,600 B2 * 12/2004 Negishi ..... H01R 4/2433 439/404
6,837,745 B2 * 1/2005 Takada ..... H01R 13/562 439/521
6,921,293 B2 * 7/2005 Takada ..... H01R 13/5829 439/352
7,059,918 B2 * 6/2006 Matsumoto ..... B60L 50/72 439/752
7,086,908 B2 * 8/2006 Fukuzaki ..... H01R 13/42 439/521
7,160,140 B1 * 1/2007 Mrakovich ..... F21V 21/002 439/417
7,318,743 B2 * 1/2008 Lu ..... H01R 4/20 439/456
7,601,037 B2 * 10/2009 Telakowski ..... H01R 4/186 439/879
7,777,133 B2 * 8/2010 Onuma ..... H01R 4/20 174/84 C
8,288,653 B2 * 10/2012 Stroh ..... H01R 4/021 174/74 R
8,597,062 B2 * 12/2013 Casses ..... H01R 4/184 439/686
9,257,772 B2 * 2/2016 Natter ..... H01R 13/42
9,653,894 B2 * 5/2017 Kitamura ..... H01R 13/64
9,825,375 B2 * 11/2017 Naganishi ..... H01R 4/185
9,973,051 B2 * 5/2018 Ogawa ..... H01R 4/184

* cited by examiner

CABLE CONNECTOR

CROSS-REFERENCE TO RELATED APPLICATION

This application claims the benefit of the filing date under 35 U.S.C. § 119(a)-(d) of Chinese Patent Application No. 201710054500.7, filed on Jan. 24, 2017.

FIELD OF THE INVENTION

The present invention relates to a cable connector and, more particularly, to a cable connector connecting to a plurality of cables having a same function.

BACKGROUND

Known cable connectors generally include a housing formed of an insulative material and one or more conductive terminals disposed in the housing. A first end of a cable is electrically connected to one conductive terminal in the cable connector and an opposite second end of the cable extends out of the cable connector and is electrically connected to an electrical device. The electrical connection between the cable and the electrical device may be a detachable or permanent. When a plurality of cables having the same function need to be simultaneously connected to a same conductive terminal, the plurality of cables are only capable of being electrically connected to a same side of the conductive terminal and being led out from a same side of the known cable connector.

The known cable connector is therefore not useful for applications requiring a plurality of cables with the same function extending out from two sides of the cable connector. When the known cable connector is formed as a power connector for distributing power to a plurality of electrical devices, for example, a plurality of power cables of the plurality of electrical devices are only capable of being inserted into the power connector from the same side thereof and electrically connected to a power terminal in the power connector. Likewise, ground cables of the plurality of electrical devices are only capable of being inserted into the power connector from the same side thereof and electrically connected to a ground terminal in the power connector.

Requiring the plurality of cables having the same function to be inserted from the same side of the cable connector limits the applicability of the cable connector and presents much difficulty in field cable arrangement, leading to an irregular arrangement of cables, which consumes wiring space and increases wiring costs.

SUMMARY

A cable connector comprises a housing having a first receiving portion extending in a longitudinal direction of the cable connector and a first terminal disposed in the first receiving portion. The first terminal has a first cable connection portion at a first end of the first terminal. The first cable connection portion has a hollow cylindrical shape with a center axis extending in a lateral direction of the cable connector. A plurality of first cables electrically connected to the first cable connection portion are inserted into a first end of the first cable connection portion or are inserted into both the first end and an opposite second end of the first cable connection portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
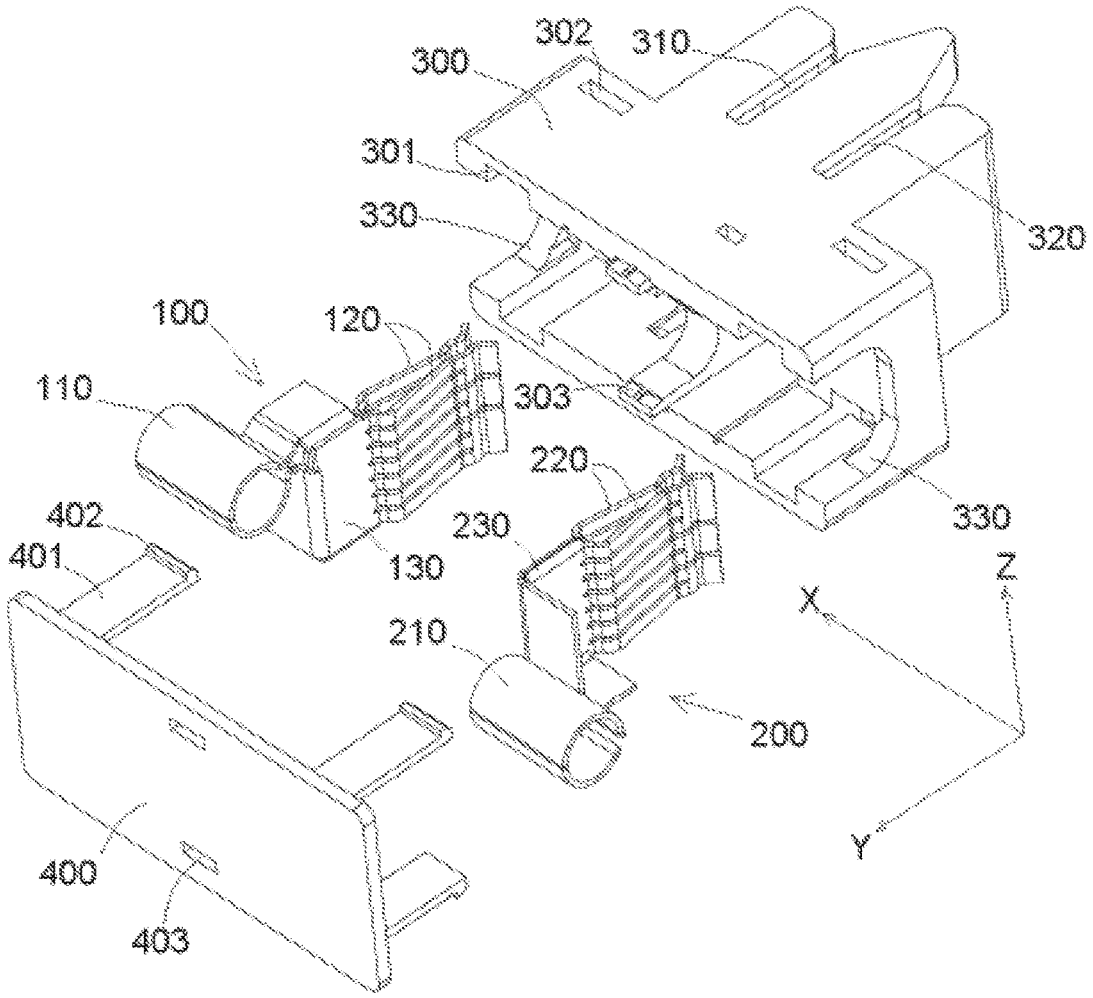
FIG. 1 is an exploded perspective view of a cable connector.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete and will fully convey the concept of the invention to those skilled in the art.

A cable connector according to the invention is shown in FIG. 1. The cable connector has a housing 300, a first terminal 100 disposed in the housing 300, and a second terminal 200 disposed in the housing 300. In the shown embodiment, the cable connector is a power connector.

Figure 2:
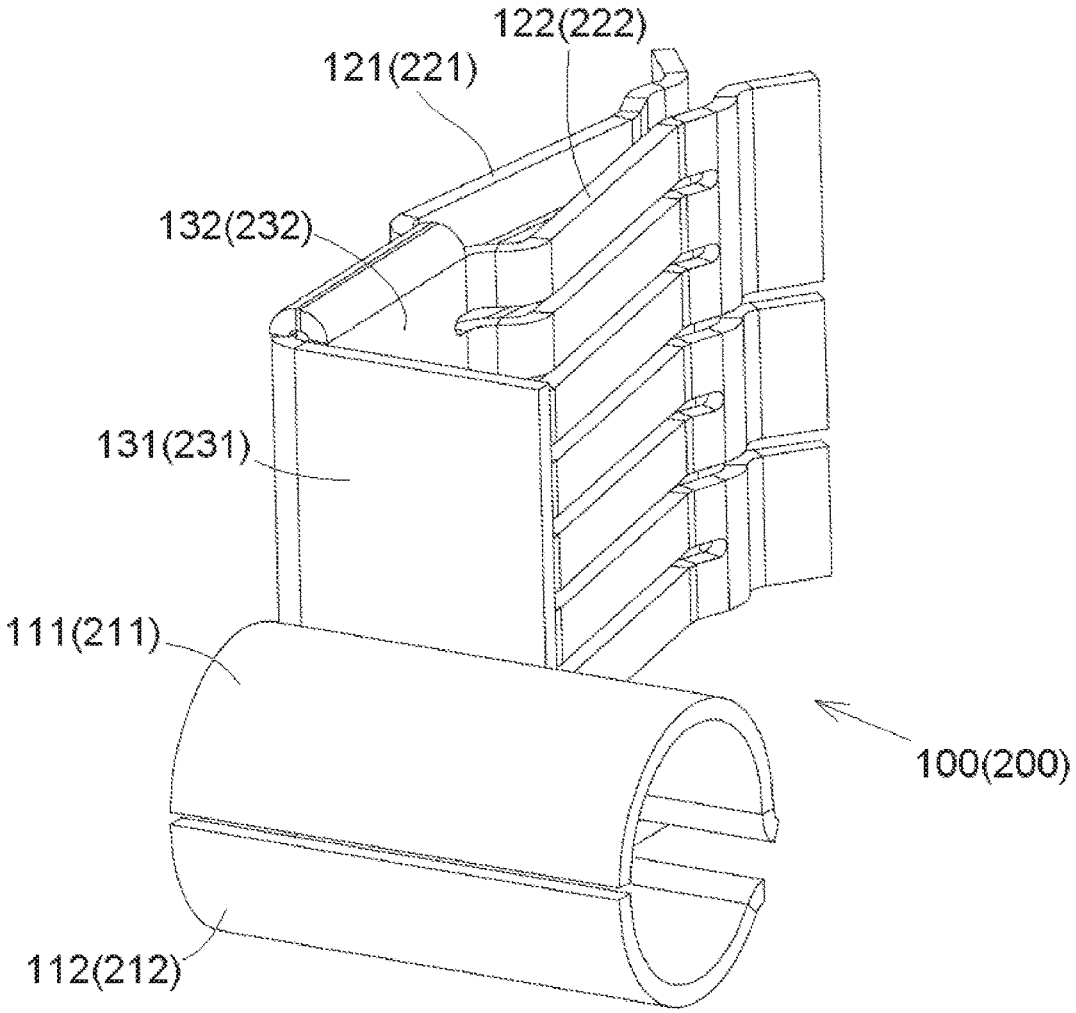
FIG. 2 is a perspective view of a terminal of the cable connector.
Figure 3:
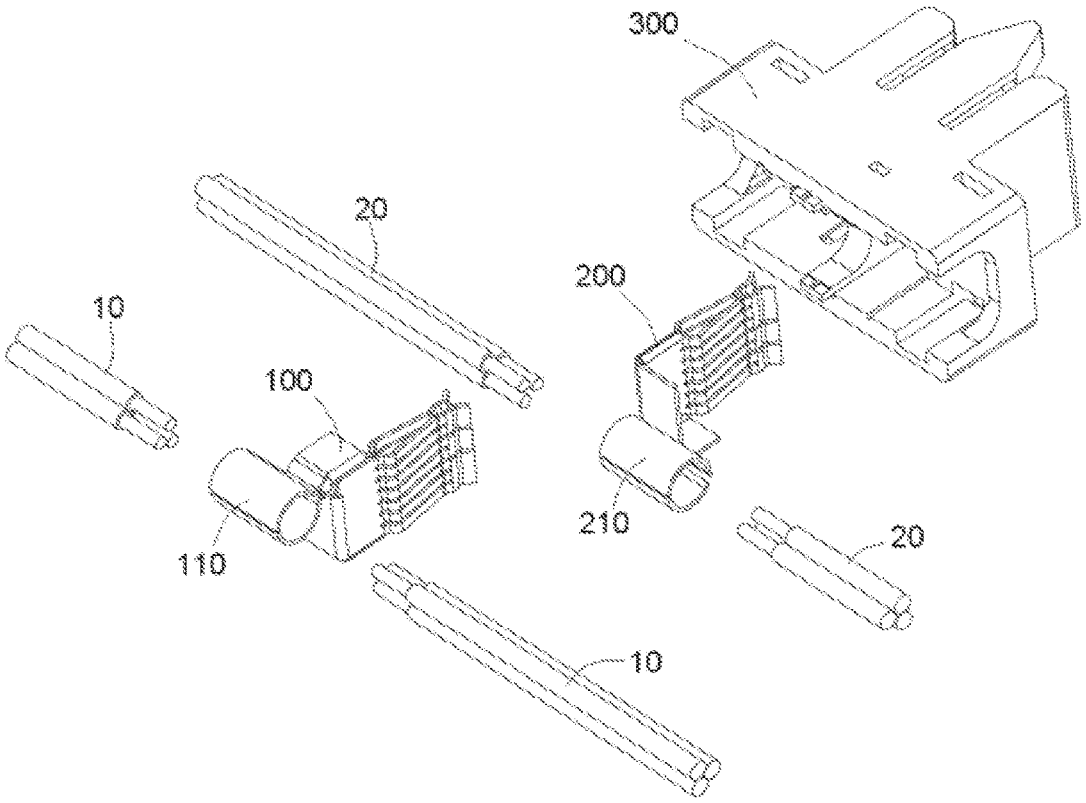
FIG. 3 is an exploded perspective view of the cable connector with a plurality of cables.
Figure 4:
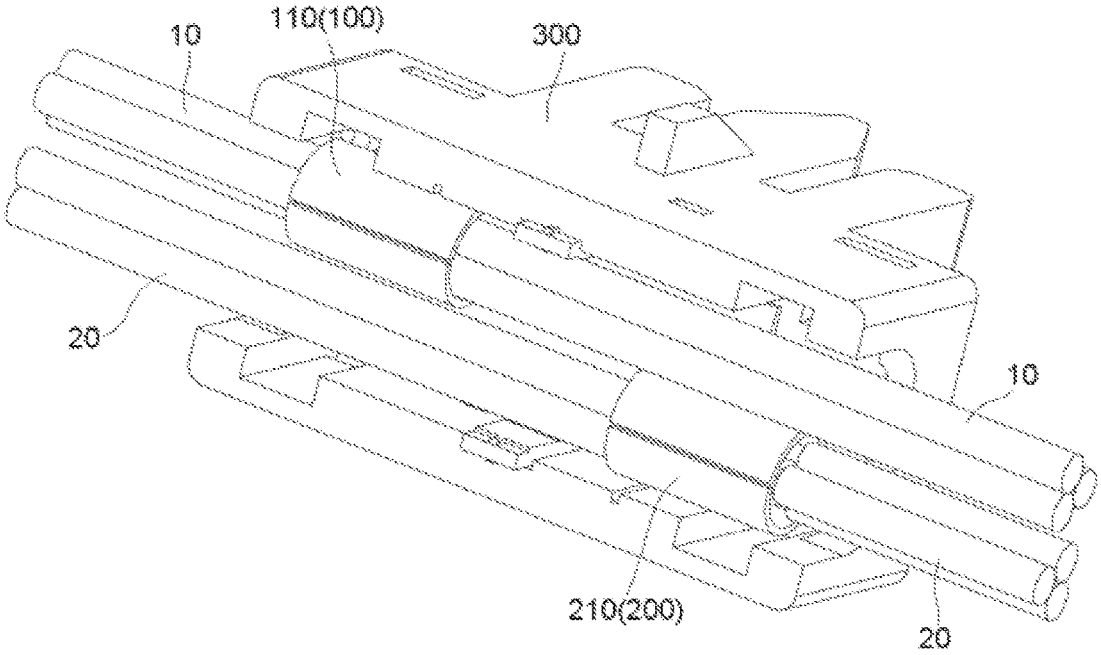
FIG. 4 is a perspective view of the cable connector with the plurality of cables inserted into both sides of the terminals.
Figure 6:
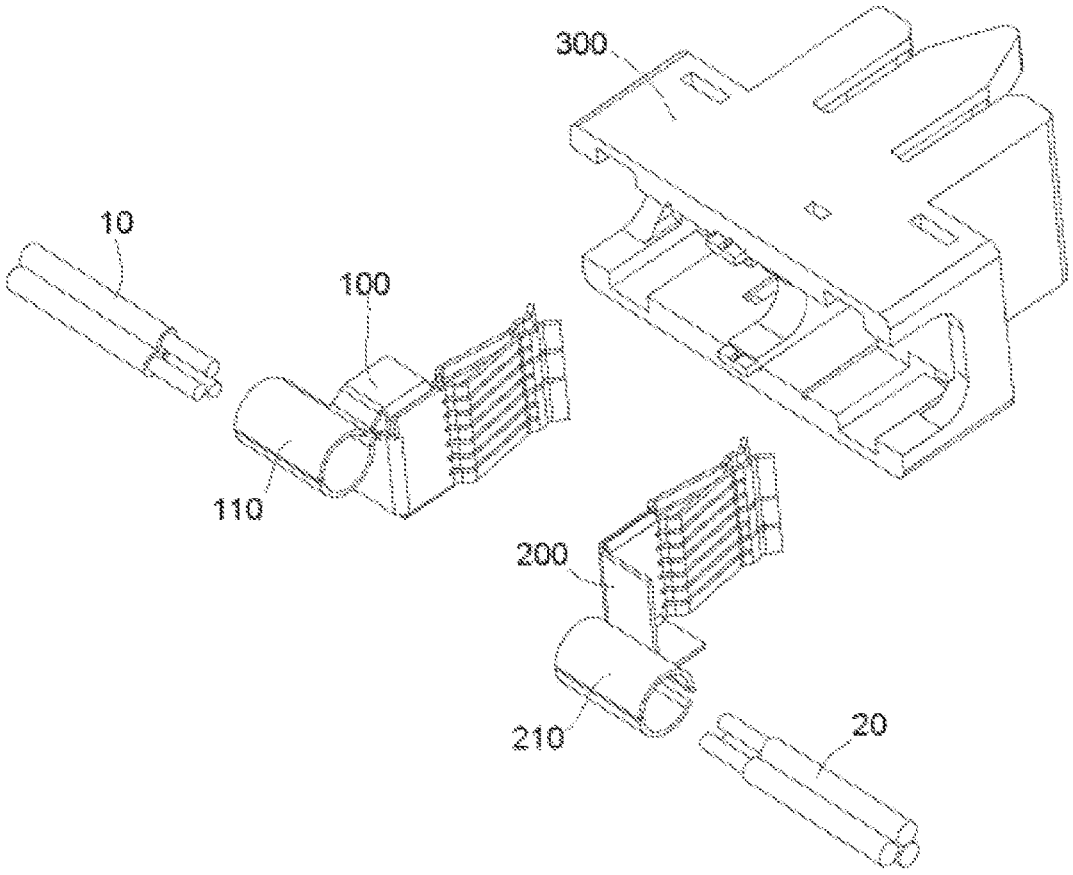
FIG. 6 is an exploded perspective view of the cable connector with the plurality of cables.
Figure 7:
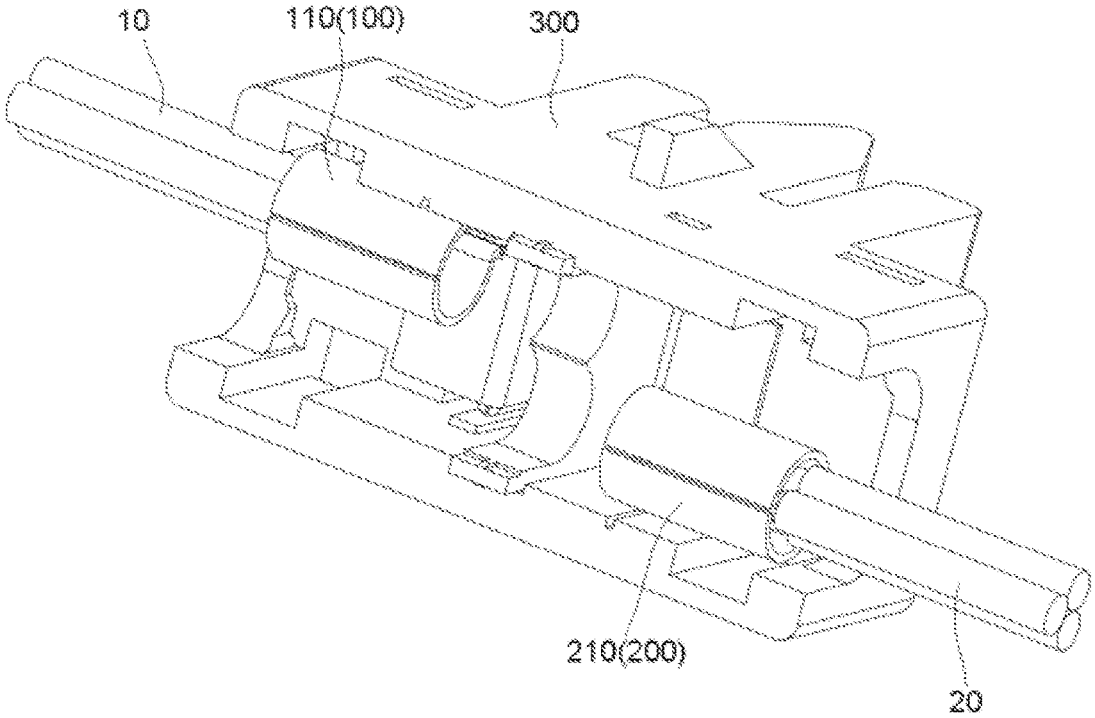
FIG. 7 is a perspective view of the cable connector with the plurality of cables inserted into one side of the terminals.

The first terminal 100, as shown in FIGS. 1 and 2, has a first cable connection portion 110 at a first end of the first terminal 100. The first cable connection portion 110 is adapted to electrically connect to a first cable 10, as shown in FIGS. 4 and 7. The first cable connection portion 110 is crimped to the first cable 10. The first cable connection portion 110 has a hollow cylindrical shape with a center axis extending in a lateral direction X. A plurality of the first cables 10 are capable of being inserted into the first terminal 100 from one end of the first cable connection portion 110, as shown in FIGS. 6 and 7. In another embodiment shown in FIGS. 3 and 4, the plurality of the first cables 10, 10 are capable of being inserted into the first terminal 100 from both ends of the first cable connection portion 110. The first cable connection portion 110 has a pair of first cylindrical halves 111, 112 facing each other as shown in FIG. 2.

The second terminal 200, as shown in FIGS. 1 and 2, has a second cable connection portion 210 at a first end of the second cable connection portion 210. The second cable connection portion 210 is adapted to electrically connect to a second cable 20, as shown in FIGS. 4 and 7. The second cable connection portion 210 is crimped to the second cable 20. The second cable connection portion 210 has a hollow cylindrical shape with a center axis extending in the lateral direction X. As shown in FIGS. 6 and 7, a plurality of the second cables 20 are capable of being inserted into the second terminal 200 from one end of the second cable connection portion 210. In another embodiment shown in FIGS. 3 and 4, the plurality of the second cables 20, 20 are capable of being inserted into the second terminal 200 from both ends of the second cable connection portion 210. The second cable connection portion 210 has a pair of second cylindrical halves 211, 212 facing each other as shown in FIG. 2. In the embodiment shown in FIGS. 1 and 2, the first terminal 100 and the second terminal 200 have an identical structure, reducing manufacturing cost.

Figure 5:
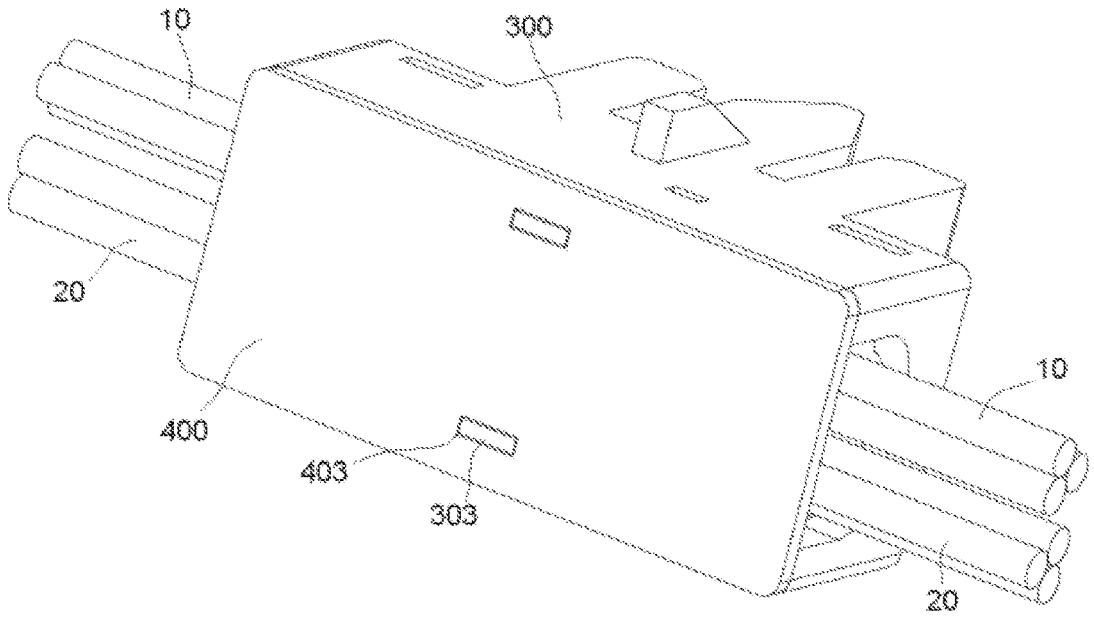
FIG. 5 is a perspective view of the cable connector of FIG. 4 with a rear cover mounted on a housing of the cable connector.
Figure 8:
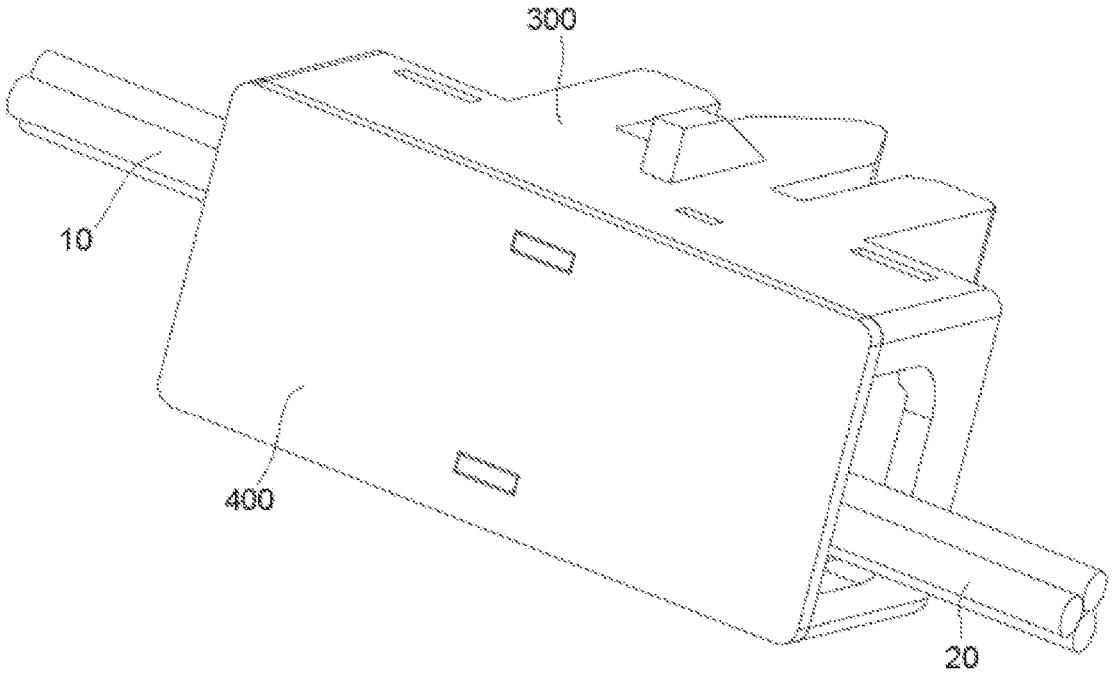
FIG. 8 is a perspective view of the cable connector of FIG. 7 with the rear cover mounted on the housing.

The housing 300 is formed of an insulative material and has a first receiving portion and a second receiving portion extending in a longitudinal direction Y. The first terminal 100 and the second terminal 200 are received in the first receiving portion and the second receiving portion of the housing 300, respectively. The housing 300, as shown in FIGS. 1, 5, and 8, has a cable exiting passage 330 at both sides thereof. The plurality of first cables 10 and/or the plurality of second cables 20 are led out from one side or both sides of the housing 300 through the cable exiting passage 330.

A rear portion of the housing 300, as shown in FIG. 1, has a receiving cavity penetrating through the housing 300 in the lateral direction X of the cable connector. The first cable connection portion 110 and the second cable connection portion 210 are located in the receiving cavity of the housing 300. As shown in FIGS. 6 and 7, the first cable 10 and the second cable 20 may be lead out from one or both sides of the receiving cavity.

As shown in FIG. 1, the housing 300 has a first slot 310 receiving a first bus bar and a second slot 320 receiving a second bus bar. The first terminal 100 has a first electrical contact portion 120 at a second end of the first terminal 100 opposite to the first cable connection portion 110. The first electrical contact portion 120 protrudes into the first slot 310 and is adapted to electrically and elastically contact the first bus bar inserted into the first slot 310. The second terminal 200 has a second electric contact portion 220 at a second end of the second terminal 200 opposite to the second cable connection portion 210. The second electrical contact portion 220 protrudes into the second slot 320 and is adapted to electrically and elastically contact the second bus bar inserted into the second slot 320. As shown in FIG. 2, the first electrical contact portion 120 has a pair of first elastic pieces 121, 122 facing each other; the first bus bar is inserted between the pair of first elastic pieces 121, 122. The second electrical contact portion 220 has a pair of second elastic pieces 221,222 facing each other; the second bus bar is inserted between the pair of second elastic pieces 221,222.

In the shown embodiment, the first terminal 100 is a power terminal and the second terminal 200 is a ground terminal. Likewise, the first cable 10 is a power cable and the second cable 20 is a ground cable, the first bus bar is a power bus bar and the second bus bar is a ground bus bar.

The first terminal 100, as shown in FIG. 2, has a first intermediate connection portion 130 connecting the first cable connection portion 110 and the first electrical contact portion 120. The first intermediate connection portion 130 has two first connection plates 131, 132 connected to and perpendicular to each other. A first side of the first connection plates 131, 132 are connected to the pair of first elastic plates 121, 122 and an opposite second side of the first connection plates 131, 132 are connected to the pair of first cylindrical halves 111, 112.

The second terminal 200, as shown in FIG. 2, has a second intermediate connection portion 230 connecting the second cable connection portion 210 and the second electrical contact portion 220. The second intermediate connection portion 230 has two second connection plates 231, 232 connected to and perpendicular to each other. A first side of the second connection plates 231, 232 are connected to the pair of second elastic plates 221, 222 and an opposite second side of the second connection plates 231, 232 are connected to the pair of second cylindrical halves 211, 212.

As shown in FIGS. 1, 4 and 7, in order to prevent the first cable 10 and the second cable 20 from interfering with each other, the first terminal 100 and the second terminal 200 are arranged in the housing 300 such that the first cable connection portion 110 and the second cable connection portion 210 are spaced apart by a distance in a height direction Z of the cable connector and a center axis of the first cable connection portion 110 and a center axis of the second cable connection portion 210 are both parallel to the lateral direction X of the cable connector.

As shown in FIG. 1, the cable connector has a rear cover 400 adapted to cover an opening of the receiving cavity. The rear cover 400 is adapted to be locked onto the housing 300 in an elastically snapped manner. The rear cover 400, as shown in FIGS. 1, 5, and 8, has a plurality of elastic legs 401, each of which has a protrusion 402 at an end thereof. A plurality of slots 301 are formed in an inner wall of the receiving cavity of the housing 300. A locking hole 302 is formed at an end of each slot 301 and extends in a thickness direction through the housing 300. The elastic leg 401 is inserted into a corresponding slot 301 and the protrusion 402 snaps into a corresponding locking hole 302 to secure the rear cover 400 to the housing 300. A plurality of positioning holes 403 are formed in the rear cover 400 and a plurality of positioning protrusions 303 are formed on a rear end wall of the housing 300. The positioning protrusions 303 are inserted into the positioning holes 403, respectively, to further secure the rear cover 400 to the housing 300.

What is claimed is:

1. A cable connector, the cable connector is a power connector comprising:

a housing having a first receiving portion extending in a longitudinal direction of the cable connector and a second receiving portion extending in the longitudinal direction and a cable exiting passage extending through each of a first side and an opposite second side of the housing; and a first terminal disposed in the first receiving portion and having a first cable connection portion at a first end of the first terminal, the first cable connection portion having a hollow cylindrical shape with a center axis extending in a lateral direction of the cable connector, a plurality of first cables electrically connected to the first cable connection portion and inserted into a first end of the first cable connection portion or inserted into both of the first end and an opposite second end of the first cable connection portion the plurality of first cables extending out of the housing through the cable exiting passage;

a second terminal disposed in the second receiving portion and having a second cable connection portion at a first end of the second terminal, the second cable connection portion having a hollow cylindrical shape with a center axis extending in the lateral direction of the cable connector, a plurality of second cables electrically connected to the second cable connection portion and inserted into a first end of the second cable connection portion or inserted into both of the first end and an opposite second end of the second cable connection portion the plurality of second cables extending out of the housing through the cable exiting passage.

2. The cable connector of claim 1, wherein the housing has a first slot adapted to receive a first bus bar and a second slot adapted to receive a second bus bar.

3. The cable connector of claim 2, wherein the first terminal has a first electrical contact portion at a second end of the first terminal opposite the first end of the first terminal, the first electrical contact portion protruding into the first slot and adapted to electrically and elastically contact the first bus bar.

4. The cable connector of claim 3, wherein the second terminal has a second electrical contact portion at a second end of the second terminal opposite the first end of the second terminal, the second electrical contact portion protruding into the second slot and adapted to electrically and elastically contact the second bus bar.

5. The cable connector of claim 4, wherein the first terminal is a power terminal, the second terminal is a ground terminal, the first cable is a power cable, the second cable is a ground cable, the first bus bar is a power bus bar, and the second bus bar is a ground bus bar.

6. The cable connector of claim 5, wherein the first terminal has a first intermediate connection portion connecting the first cable connection portion and the first electrical contact portion and the second terminal has a second intermediate connection portion connecting the second cable connection portion and the second electrical contact portion.

7. The cable connector of claim 6, wherein the first electrical contact portion has a pair of first elastic pieces facing each other, the first bus bar inserted between the pair of first elastic pieces, and the second electrical contact portion has a pair of second elastic pieces facing each other, the second bus bar inserted between the pair of second elastic pieces.

8. The cable connector of claim 6, wherein the first cable connection portion has a pair of first cylindrical halves facing each other and the second cable connection portion has a pair of second cylindrical halves facing each other.

9. The cable connector of claim 8, wherein the first intermediate connection portion has a pair of first connection plates connected to each other, one of the pair of first connection plates is connected to the pair of first elastic plates and the other of the pair of first connection plates is connected to the pair of first cylindrical halves.

10. The cable connector of claim 9, wherein the second intermediate connection portion has a pair of second connection plates connected to each other, one of the pair of second connection plates is connected to the pair of second elastic plates and the other of the pair of second connection plates is connected to the pair of second cylindrical halves.

11. The cable connector of claim 1, wherein the first terminal and the second terminal have an identical structure.

12. The cable connector of claim 11, wherein the first terminal and the second terminal are disposed in the housing such that the first cable connection portion and the second cable connection portion are spaced apart by a distance in a height direction of the cable connector and the center axis of the first cable connection portion and the center axis of the second cable connection portion are both parallel to the lateral direction of the cable connector.

13. The cable connector of claim 1, wherein the first cable connection portion is crimped to the plurality of first cables and the second cable connection portion is crimped to the plurality of second cables.

14. The cable connector of claim 1, wherein the housing has a rear portion with a receiving cavity extending through the housing in the lateral direction of the cable connector, the first cable connection portion and the second cable connection portion are disposed in the receiving cavity and extend out from the receiving cavity.

15. The cable connector of claim 14, further comprising a rear cover adapted to cover an opening of the receiving cavity.

16. The cable connector of claim 15, wherein the rear cover is adapted to be elastically locked to the housing.

17. The cable connector of claim 16, wherein the rear cover has a plurality of elastic legs with a protrusion at an end of each elastic leg, an inner wall of the receiving cavity of the hosing has a plurality of slots with a locking hole disposed at an end of each slot, and the elastic legs are inserted into the slots and the protrusions engage the locking holes to secure the rear cover to the housing.

18. The cable connector of claim 17, wherein the rear cover has a plurality of positioning holes and a rear end wall of the housing has a plurality of positioning protrusions, the positioning protrusions inserted into the positioning holes.

* * * * *